United States Patent [19]

McKelvey et al.

[11] 4,014,312

[45] Mar. 29, 1977

[54] OVEN DOOR WINDOWS

[75] Inventors: Harold E. McKelvey; Leonard B. Maciejewski, both of Plymouth, Mich.

[73] Assignee: Shatterproof Glass Corporation, Detroit, Mich.

[22] Filed: Dec. 1, 1975

[21] Appl. No.: 636,635

[52] U.S. Cl. ..... 126/198; 126/200

[51] Int. Cl.[2] ..... F24C 15/04

[58] Field of Search ..... 126/198, 200, 21 A, 126/21 R; 52/304, 616, 399, 171, 198; 98/96; 62/248; 110/179

[56] References Cited

UNITED STATES PATENTS

| | | | |
|---|---|---|---|
| 3,500,815 | 3/1970 | De Weese et al. | 126/198 |
| 3,692,015 | 9/1972 | Chase et al. | 126/200 |
| 3,717,138 | 2/1973 | Upp | 126/200 |
| 3,893,442 | 7/1975 | Nuss | 126/198 |

*Primary Examiner*—John J. Camby
*Assistant Examiner*—Larry I. Schwartz
*Attorney, Agent, or Firm*—William E. Nobbe

[57] ABSTRACT

A ventilated window for oven doors comprising at least two spaced parallel glass panels mounted in a frame surrounding the peripheral edges of the panels, said frame being comprised of spaced glass receiving channels and an integral spacer portion between the channels, the spacer portions at the top and bottom of the window being formed with angled fins or vanes to provide relatively narrow elongated louvers which extend substantially the entire width of the window for directing a flow of cooler air upwardly through the space between the glass panels to replace the hotter air therein.

10 Claims, 7 Drawing Figures

OVEN DOOR WINDOWS

SUMMARY OF THE INVENTION

The present invention relates broadly to windows and more particularly to window units constituting a part of an oven door for cooking ranges.

Window units for oven doors are customarily comprised of at least two spaced parallel glass panels, the air space between them serving as an insulator to retard the escape of oven heat through the window. Ordinarily, the spaced glass panels are sealed around the peripheral edges thereof to provide a dead air space therebetween. However, it has also been proposed to mount the glass panels in the oven door in such a way that the space between the panels is ventilated to provide for replacement of heated air therein by cooler air.

This invention is primarily concerned with the provision of a new and improved type of ventilated oven door window which will minimize heat loss through the window while providing adequate visibility of the oven interior during the cooking process.

Another object of the invention is the provision of an oven door window of the above character including means for continuously circulating a stream or blanket of cooler air through the space between the glass panels in such a manner as to maintain the temperature of the outer glass panel within the manufacturer's recommended safety level, as well as maintaining a more even heat distribution in the oven itself.

Another object of the invention is to provide an oven door window unit comprising a frame surrounding the peripheral edges of the spaced parallel glass panels, said frame including glass receiving channels and a spacer portion therebetween, the spacer portions at the top and bottom of the window being provided with relatively narrow elongated louvers for directing a flow of cooler air upwardly therethrough across substantially the entire width of the window, the cooler air entering the space between the glass panels at the bottom of the window and exiting at the top thereof.

A further object of the invention is to provide an oven door window unit of simplified yet functional design which can be readily mounted in the oven door and which is of high quality, durable and of attractive appearance.

These and other objects and advantages of the invention will be apparent from the following description when taken in connection with the accompanying drawings.

DESCRIPTION OF THE PREFERRED EMBODIMENTS

Figure 1:
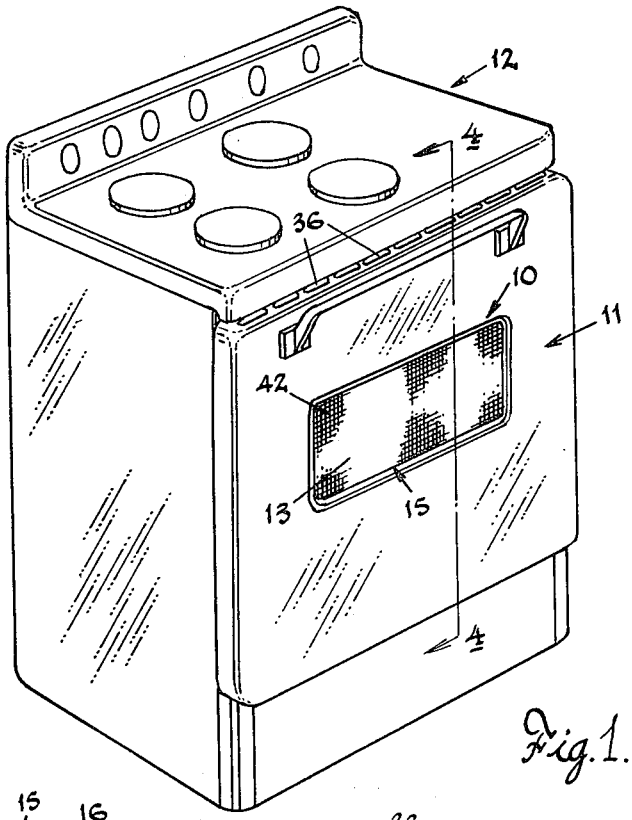
FIG. 1 is a perspective view of a domestic cooking range employing a window unit for the oven door constructed in accordance with the present invention.
Figure 2:
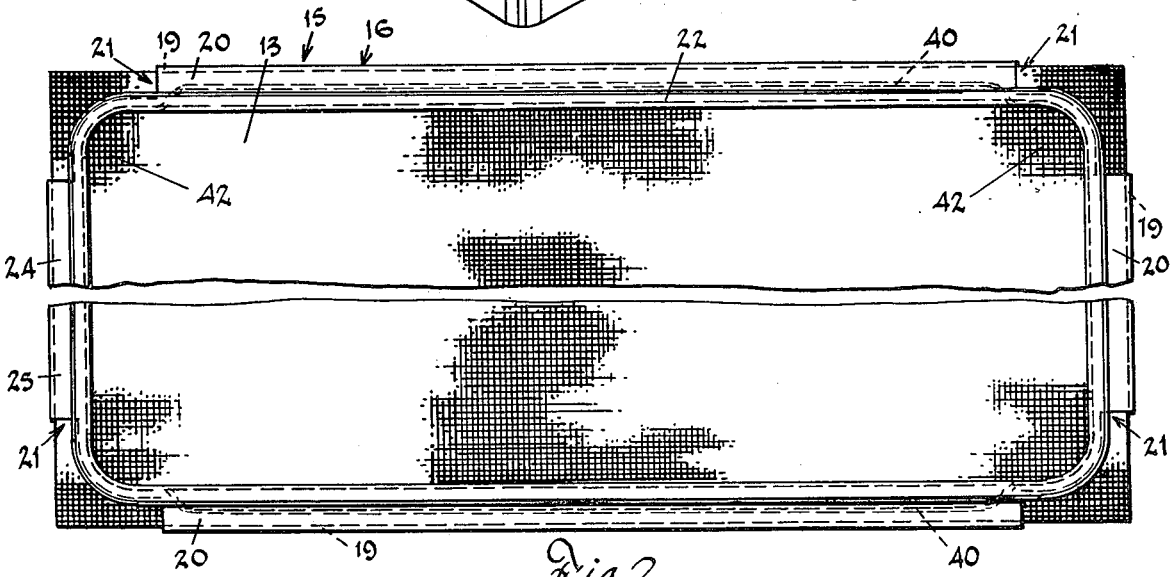
FIG. 2 is a front view of the window unit removed from the oven door.
Figure 3:
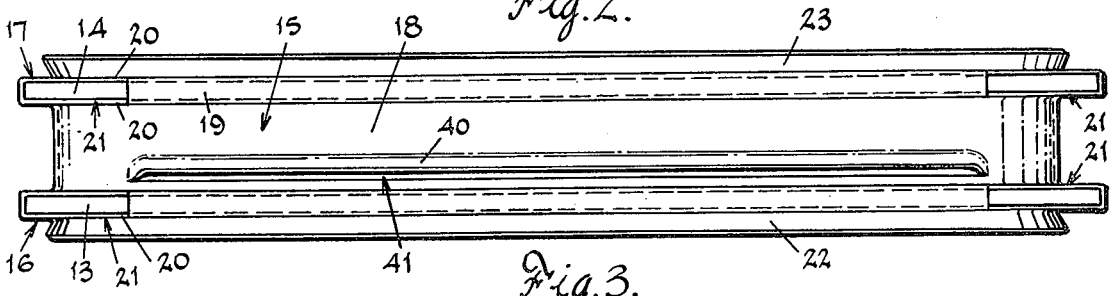
FIG. 3 is a top view of the window unit.

With reference now to the drawings and particularly to FIG. 1, there is shown a window unit 10 constructed in accordance with the principles of the present invention and mounted in the oven door 11 of a floor standing cooking range 12.

Referring more particularly to the embodiment of the invention illustrated in FIGS. 2 to 5, the window unit 10 comprises spaced outer and inner transparent glass panels 13 and 14 and a frame 15 of relatively light metal enclosing the peripheral edges of the glass panels to secure them in their spaced parallel relation.

The glass panels 13 and 14 shown in the drawings are generally rectangular and the frame 15 is designed to conform to the generally rectangular perimeter of the glass panels, said frame being provided with two parallel continuous glass receiving channels 16 and 17 which are separated by an integral spacer portion 18. At the corners of the window unit, the end walls 19 and portions of the side walls 20 of the glass receiving channels 16 and 17 are preferably cut out to form notched corner apertures 21 to permit bending of the frame without undesirable crimping and wrinkling at the corners as well as to permit the use of rectangular glass panels. Flanged rim portions 22 and 23 extend from the outer walls of the channel portions 16 and 17 respectively.

The metal frame 15 is preferably formed of two substantially U-shaped sections 24 and 25 which can be joined together at opposite sides of the frame in any suitable manner such as by the interlocking means disclosed in U.S. Pat. No. 3,418,779 dated Dec. 31, 1968.

The oven door 11 is generally of sheet metal construction and includes a front or outer door panel 26 and a rear or inner door panel 27, said panels being provided with aligned substantially rectangular openings therein defined by inwardly turned flanges 28 and 29 respectively which form a substantially centrally located window opening in which the window unit 10 is mounted. The door panels 26 and 27 are formed around their respective perimeters with interfitting flanges 30 and 31 which serve to locate them in predetermined spaced relation and which may be secured in assembled relation by spot welding or the like.

A reinforcing partition member 32, which may also be of sheet metal, is installed between the outer and inner door panels 26 and 27 to impart strength and rigidity to the door structure. The partition 32 is preferably disposed substantially midway between the outer and inner door panels, with the space rearwardly of said partition being filled with an insulating material 33, such as fiber glass, to prevent excessive heating of the outer door panel when the oven is in use, while the space 34 forwardly of partition 32 is an open area through which the cooler air is channeled to the window unit and the hotter air therefrom. The cooler air enters the space 34 through openings 35 in the bottom of the door 11 and, after passing upwardly through the space between the glass panels, exits through openings 36 in the top of the door.

This invention is particularly concerned with providing a more uniform flow of air through the space between the glass panels and across substantially the entire width of said panels in such manner as to effect a more uniform cooling of the outer glass panel, as well as a more even distribution of heat in the oven itself.

Also by uniformily cooling the outer glass panel across its entire width, the creation of excessive hot spots or areas in the panel will be eliminated.

This is accomplished by the provision of louvers 38 and 39 at the top and bottom of the window unit for directing the flow of cooler air upwardly into, through and out of the space between the glass panels. More particularly, each louver 38 and 39 consists of a relatively narrow elongated fin or vane 40 formed integral with the respective spacer portion 18 and disposed at an angle relative thereto. The vanes 40 are struck from the spacer portions 18 resulting in correspondingly narrow elongated slots 41 defining passages for the circulation of air through the space between the glass panels, as indicated by the arrows in FIG. 4. The louvers extend substantially the entire width of the window to provide a uniform stream or blanket of air across the entire surface of the outer glass panel. The vane 40 of the louver 39 at the top of the window is angled forwardly and downwardly, while the vane of the louver 38 at the bottom thereof is angled forwardly and downwardly.

In order for an oven range to be acceptable for domestic use, it is required that the outer surface of the outer glass panel not exceed a specified temperature, the purpose being, of course, to prevent persons and especially children, from being burned should they accidently come in contact with the panel. The louvers 38 and 39 have proven to be highly effective in reducing the temperature of the outer glass panel to and maintaining it at an acceptable level. This is attested to by the fact that the window unit of this invention has successfully met the latest requirements of Underwriters Laboratories for maximum permissible surface temperature of the outer glass panel.

The vanes 40 of the louvers 38 and 39 are usually disposed at an angle of about 45° relative to the spacer portions 18; however, they may be arranged at other angles as the particular oven construction and thermal requirements dictate. The angle of the vanes serves to determine the rate and/or volume of air passing upwardly through the louvers into and through the window unit. It has been found that if the flow of cooler air into the bottom of the window is not properly regulated, the hot air therein will be forced upwardly into the space 34 above the window at such a rate that it will tend to back-up in the space 34 such as to cause overheating of the front metal door panel above the window. This is highly objectional in that the outer door panel must also not exceed a permissible maximum surface temperature.

If desired, a screen in the form of a grid-like or foranimous coating 42 may be applied to the outer surface of the outer glass panel 13. The screen has a plurality of apertures or foramens 43 in regular disposition throughout the area of the glass panel and of such size that the screen will permit viewing of the oven interior when the door is closed and the oven light on to observe the advance of the cooking process.

The screen 42 is preferably formed by applying a suitable ceramic paint to the glass panel by the silk screen technique, using a squeegee after which the coated glass panel is subjected to an elevated temperature sufficiently high to fuse the layer of ceramic paint to the glass. While black ceramic paint is preferred, white or other colored paint may be uased as desired. Although the screen does not play an important role in the cooling of the outer glass panel it does enhance the appearance of the window. Also the screen tends to obscure any dust and dirt that may be deposited on the inner surfaces of the glass panels as well as concealing any pots and pans placed in the oven when it is not in use.

Figure 4:
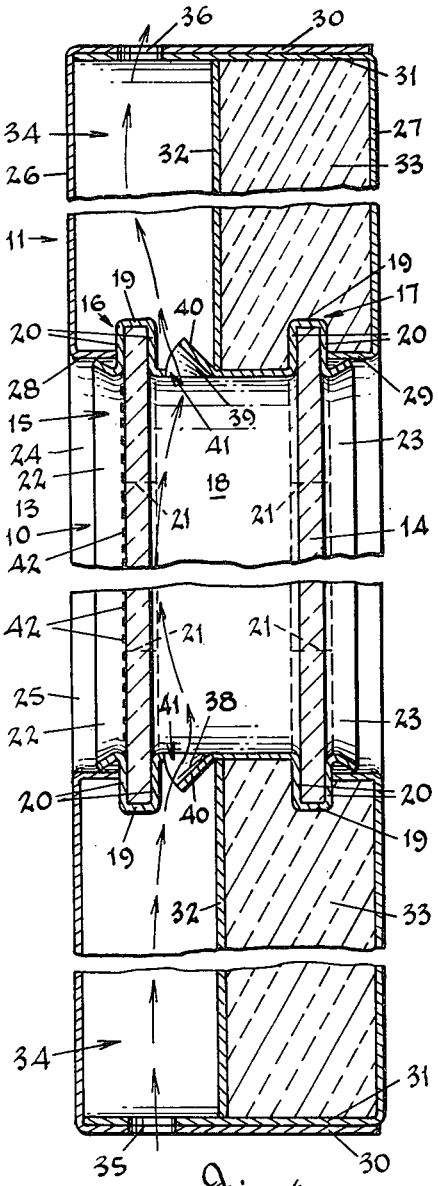
FIG. 4 is a vertical transverse sectional view taken substantially on line 4—4 of FIG. 1.
Figure 5:
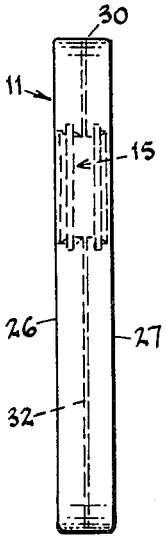
FIG. 5 is an end view of the window unit.
Figure 6:
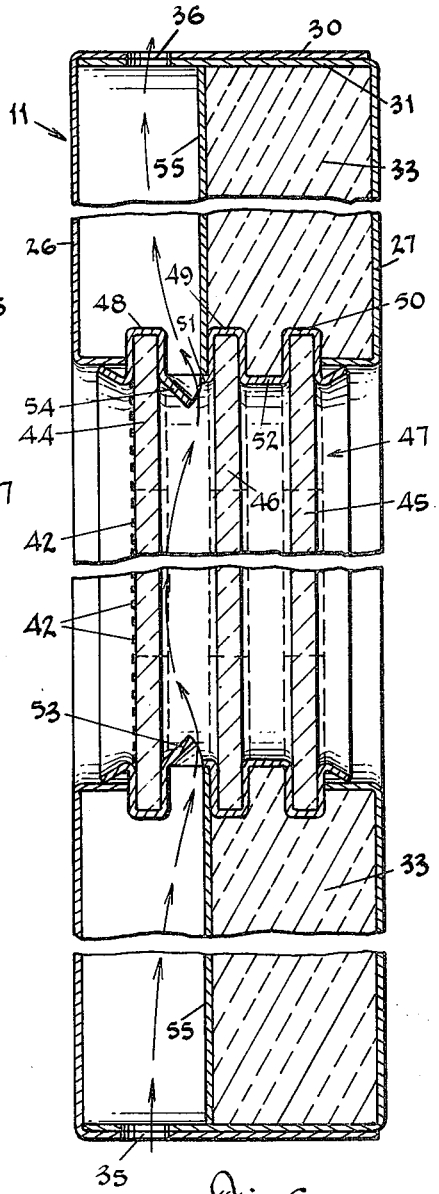
FIG. 6 is a vertical transverse sectional view similar to FIG. 4 but showing another embodiment of the invention.
Figure 7:
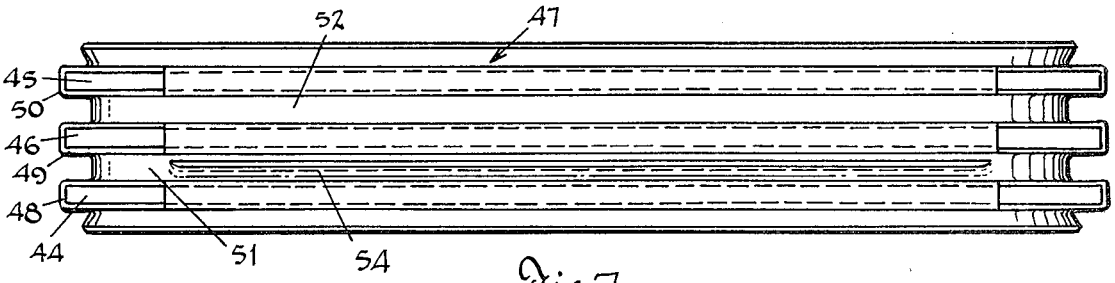
FIG. 7 is a top view of the window unit of FIG. 6.

In FIGS. 6 and 7 is illustrated another embodiment of the window unit which incorporates the principles of the present invention. The main difference between this window and the one disclosed in FIG. 4 is that it includes three spaced parallel glass panels comprising a front or outer glass panel 44, an inner or rear glass panel 45 and a center glass panel 46. The three panels are mounted in a metal frame 47 of substantially the same design as that shown in FIG. 4, except that it is formed with three glass receiving channels 48, 49 and 50 separated by the integral spacer portions 51 and 52.

The window unit of FIGS. 6 and 7 is preferably of substantially the same overall dimensions as the window unit of FIG. 4 so that it is interchangeable with said unit in the oven door 11. To this end, the spaces between the glass panels 44, 45 and 46 are somewhat less than in the two-panel unit of FIG. 4. The three glass panels are preferably equally spaced from one another and the louvers 53 and 54 at the bottom and top of the window are formed in the spacer portion 51 between the outer glass panel 44 and the center glass panel 46. The louvers 53 and 54 are of the same design and function in the same way as the louvers 38 and 39 in the two-panel unit of FIG. 4. However, the louver 53 at the bottom of the window is angled upwardly and rearwardly, while the louver 54 at the top of the window is angled rearwardly and downwardly. The reinforcing partition member 55 is preferably mounted forwardly of the center glass panel 46.

It is to be understood that the present disclosure has been made only by way of example and that modifications and changes may be resorted to without departing from the spirit and scope of the invention as hereinafter claimed.

We claim:

1. A window unit for oven doors, comprising at least two spaced parallel glass panels, a frame surrounding the peripheral edges of said glass panels for maintaining them spaced from one another, said frame comprising two spaced channels for receiving the peripheral edges of the glass panels and a spacer portion between and integral with said channels, and louvers provided in the spacer portions at the top and bottom of said frame and extending substantially the entire width of said glass panels and being provided with passages for the circulation of air through the space between the glass panels.

2. A window unit as claimed in claim 1, in which each said louver consists of a relatively narrow elongated vane formed integral with the respective spacer portion and disposed at an angle relative thereto, said vanes overlying correspondingly narrow elongated slots in the respective spacer portions, said vanes and slots extending substantially the entire width of the glass panels.

3. A window unit as claimed in claim 2, in which said vanes are struck from said spacer portions resulting in said narrow elongated slots.

4. An oven door comprising, a main body portion including spaced front and rear panels secured together around the perimeters thereof and having a substantially rectangular window opening therein, a window unit mounted in said window opening including spaced parallel glass panels, a frame enclosing the peripheral edges of said glass panels for maintaining them spaced from one another, said frame comprising two spaced channels for receiving the peripheral edges of the glass panels and a spacer portion between and integral with said channels, and louvers provided in the spacer portions at the top and bottom of the frame and extending substantially the entire width of the glass panels through which air is circulated through the space between the glass panels, said door being provided with openings at the bottom thereof for channeling cooler air to the window unit and openings at the top thereof for carrying away the hotter air from said window unit.

5. An oven door as claimed in claim 4, in which each said louver consists of a relatively narrow elongated vane formed integral with the respective spacer portion and disposed at an angle relative thereto, said vanes overlying correspondingly narrow elongated slots in the respective spacer portions, said vanes and slots extending substantially the entire width of the glass panels.

6. An oven door as claimed in claim 5, in which said vanes are struck from said spacer portions resulting in said narrow elongated slots.

7. An oven door as claimed in claim 5, including a vertical partition mounted in the door substantially midway between the glass panels to divide the interior of the door to provide a space rearwardly of the partition and a space forwardly of said partition, the space forwardly of the partition being open, with the openings in the top and bottom of the body portion of the door communicating with said open space.

8. An oven door as claimed in claim 7, in which the louvers at the top and bottom of the frame are provided in the respective spacer portions forwardly of said partition.

9. A window unit as claimed in claim 1, in which said unit comprises three spaced parallel glass panels including an outer panel, a center panel and an inner panel, in which said frame comprises three spaced channels for receiving the peripheral edges of the glass panels therein and spacer portions between and integral with said channels, and in which said louvers are formed in the spacer portions between the outer and center glass panels.

10. An oven door as claimed in claim 7, in which the window unit comprises three spaced parallel glass panels including an outer panel, a center panel and an inner panel, in which said frame comprises three spaced channels for receiving the peripheral edges of the glass panels therein and spacer portions between and integral with said channels, in which said partition is disposed forwardly of the center glass panel, and in which said louvers are formed in the spacer portions between the outer and center glass panels.

* * * * *